US009924741B2

(12) United States Patent
Collett et al.

(10) Patent No.: US 9,924,741 B2
(45) Date of Patent: Mar. 27, 2018

(54) METHOD OF PREPARING AN AEROSOL DELIVERY DEVICE

(71) Applicant: R.J. Reynolds Tobacco Company, Winston-Salem, NC (US)

(72) Inventors: William Robert Collett, Lexington, NC (US); Stephen Benson Sears, Siler City, NC (US); Karen V. Taluskie, Cary, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 997 days.

(21) Appl. No.: 14/269,635

(22) Filed: May 5, 2014

(65) Prior Publication Data

US 2015/0313283 A1 Nov. 5, 2015

(51) Int. Cl.
*A24F 47/00* (2006.01)
*H05B 3/06* (2006.01)

(52) U.S. Cl.
CPC ..... *A24F 47/008* (2013.01); *H05B 3/06* (2013.01)

(58) Field of Classification Search
CPC ..... A24F 7/008
See application file for complete search history.

(56) References Cited

U.S. PATENT DOCUMENTS

| | | | |
|---|---|---|---|
| 1,771,366 | A | 7/1930 | Wyss et al. |
| 2,057,353 | A | 10/1936 | Whittemore, Jr. |
| 2,104,266 | A | 1/1938 | McCormick |
| 2,805,669 | A | 9/1957 | Meriro |
| 3,200,819 | A | 4/1963 | Gilbert |
| 3,398,754 | A | 6/1966 | Tughan |
| 3,316,919 | A | 5/1967 | Green et al. |
| 3,419,015 | A | 12/1968 | Wochnowski |
| 3,424,171 | A | 1/1969 | Rooker |
| 3,476,118 | A | 11/1969 | Luttich |
| 4,054,145 | A | 10/1977 | Berndt et al. |
| 4,131,117 | A | 12/1978 | Kite et al. |
| 4,150,677 | A | 4/1979 | Osborne |
| 4,190,046 | A | 2/1980 | Virag |
| 4,219,032 | A | 8/1980 | Tabatznik et al. |
| 4,259,970 | A | 4/1981 | Green, Jr. |

(Continued)

FOREIGN PATENT DOCUMENTS

| | | |
|---|---|---|
| AU | 276250 | 7/1965 |
| CA | 2 641 869 | 5/2010 |

(Continued)

*Primary Examiner* — Timothy L Maust
*Assistant Examiner* — Timothy P Kelly
(74) *Attorney, Agent, or Firm* — Womble Bond Dickinson (US) LLP

(57) ABSTRACT

The present disclosure relates to an aerosol delivery device, an input for such devices, and methods of preparing such devices. In some embodiments, the present disclosure provides a method of forming an aerosol delivery device, which can comprise providing a fibrous substrate, providing a shell, wetting the fibrous substrate with a wetting liquid, and inserting the wetted fibrous substrate into the shell. After the inserting step, the shell further can comprise one or more of a heater, a liquid transport element, and an electrical connection. In some embodiments, the present disclosure provides an input that can comprise a liquid transport element, a heater in a heating arrangement with the liquid transport element, and a wetted fibrous substrate wrapped around at least a portion of the liquid transport element.

20 Claims, 4 Drawing Sheets

(56) References Cited

U.S. PATENT DOCUMENTS 4,284,089 A 8/1981 Ray
4,303,083 A 12/1981 Burruss, Jr.
4,449,541 A 5/1984 Mays et al.
4,506,682 A 3/1985 Muller
4,635,651 A 1/1987 Jacobs
4,674,519 A 6/1987 Keritsis et al.
4,708,151 A 11/1987 Shelar
4,714,082 A 12/1987 Banerjee et al.
4,735,217 A 4/1988 Gerth et al.
4,756,318 A 7/1988 Clearman et al.
4,771,795 A 9/1988 White et al.
4,776,353 A 10/1988 Lilja et al.
4,793,365 A 12/1988 Sensabaugh, Jr. et al.
4,800,903 A 1/1989 Ray et al.
4,819,665 A 4/1989 Roberts et al.
4,821,749 A 4/1989 Toft et al.
4,830,028 A 5/1989 Lawson et al.
4,836,224 A 6/1989 Lawson et al.
4,836,225 A 6/1989 Sudoh
4,848,374 A 7/1989 Chard et al.
4,848,376 A 7/1989 Lilja et al.
4,874,000 A 10/1989 Tamol et al.
4,880,018 A 11/1989 Graves, Jr. et al.
4,887,619 A 12/1989 Burcham, Jr. et al.
4,907,606 A 3/1990 Lilja et al.
4,913,168 A 4/1990 Potter et al.
4,917,119 A 4/1990 Potter et al.
4,917,128 A 4/1990 Clearman et al.
4,922,901 A 5/1990 Brooks et al.
4,924,888 A 5/1990 Perfetti et al.
4,928,714 A 5/1990 Shannon
4,938,236 A 7/1990 Banerjee et al.
4,941,483 A 7/1990 Ridings et al.
4,941,484 A 7/1990 Clapp et al.
4,945,931 A 8/1990 Gori
4,947,874 A 8/1990 Brooks et al.
4,947,875 A 8/1990 Brooks et al.
4,972,854 A 11/1990 Kiernan et al.
4,972,855 A 11/1990 Kuriyama et al.
4,986,286 A 1/1991 Roberts et al.
4,987,906 A 1/1991 Young et al.
5,005,593 A 4/1991 Fagg
5,019,122 A 5/1991 Clearman et al.
5,022,416 A 6/1991 Watson
5,042,510 A 8/1991 Curtiss et al.
5,056,537 A 10/1991 Brown et al.
5,060,669 A 10/1991 White et al.
5,060,671 A 10/1991 Counts et al.
5,065,775 A 11/1991 Fagg
5,072,744 A 12/1991 Luke et al.
5,074,319 A 12/1991 White et al.
5,076,296 A 12/1991 Nystrom et al.
5,093,894 A 3/1992 Deevi et al.
5,095,921 A 3/1992 Losee et al.
5,097,850 A 3/1992 Braunshteyn et al.
5,099,862 A 3/1992 White et al.
5,099,864 A 3/1992 Young et al.
5,103,842 A 4/1992 Strang et al.
5,121,757 A 6/1992 White et al.
5,129,409 A 7/1992 White et al.
5,131,415 A 7/1992 Munoz et al.
5,144,962 A 8/1992 Counts et al.
5,143,097 A 9/1992 Sohn et al.
5,146,934 A 9/1992 Deevi et al.
5,159,940 A 11/1992 Hayward et al.
5,159,942 A 11/1992 Brinkley et al.
5,179,966 A 1/1993 Losee et al.
5,211,684 A 5/1993 Shannon et al.
5,220,930 A 6/1993 Gentry
5,224,498 A 7/1993 Deevi et al.
5,228,460 A 7/1993 Sprinkel, Jr. et al.
5,230,354 A 7/1993 Smith et al.
5,235,992 A 8/1993 Sensabaugh
5,243,999 A 9/1993 Smith
5,246,018 A 9/1993 Deevi et al.
5,249,586 A 10/1993 Morgan et al.
5,261,424 A 11/1993 Sprinkel, Jr.
5,269,327 A 12/1993 Counts et al.
5,285,798 A 2/1994 Banerjee et al.
5,293,883 A 3/1994 Edwards
5,301,694 A 4/1994 Raymond
5,303,720 A 4/1994 Banerjee et al.
5,318,050 A 6/1994 Gonzalez-Parra et al.
5,322,075 A 6/1994 Deevi et al.
5,322,076 A 6/1994 Brinkley et al.
5,339,838 A 8/1994 Young et al.
5,345,951 A 9/1994 Serrano et al.
5,353,813 A 10/1994 Deevi et al.
5,357,984 A 10/1994 Farrier et al.
5,360,023 A 11/1994 Blakley et al.
5,369,723 A 11/1994 Counts et al.
5,372,148 A 12/1994 McCafferty et al.
5,377,698 A 1/1995 Litzinger et al.
5,388,574 A 2/1995 Ingebrethsen et al.
5,388,594 A 2/1995 Counts et al.
5,408,574 A 4/1995 Deevi et al.
5,435,325 A 7/1995 Clapp et al.
5,445,169 A 8/1995 Brinkley et al.
5,468,266 A 11/1995 Bensalem et al.
5,468,936 A 11/1995 Deevi et al.
5,479,948 A 1/1996 Counts et al.
5,498,850 A 3/1996 Das
5,498,855 A 3/1996 Deevi et al.
5,499,636 A 3/1996 Baggett, Jr. et al.
5,501,237 A 3/1996 Young et al.
5,505,214 A 4/1996 Collins et al.
5,515,842 A 5/1996 Ramseyer et al.
5,530,225 A 6/1996 Hajaligol
5,551,450 A 9/1996 Hemsley
5,551,451 A 9/1996 Riggs et al.
5,564,442 A 10/1996 MacDonald et al.
5,573,692 A 11/1996 Das et al.
5,591,368 A 1/1997 Fleischhauer et al.
5,593,792 A 1/1997 Farrier et al.
5,595,577 A 1/1997 Bensalem et al.
5,596,706 A 1/1997 Sikk et al.
5,611,360 A 3/1997 Tang
5,613,504 A 3/1997 Collins et al.
5,613,505 A 3/1997 Campbell et al.
5,649,552 A 7/1997 Cho et al.
5,649,554 A 7/1997 Sprinkel et al.
5,659,656 A 8/1997 Das
5,665,262 A 9/1997 Hajaligol et al.
5,666,976 A 9/1997 Adams et al.
5,666,977 A 9/1997 Higgins et al.
5,666,978 A 9/1997 Counts et al.
5,687,746 A 11/1997 Rose et al.
5,692,525 A 12/1997 Counts et al.
5,692,526 A 12/1997 Adams et al.
5,708,258 A 1/1998 Counts et al.
5,711,320 A 1/1998 Martin
5,726,421 A 3/1998 Fleischhauer et al.
5,727,571 A 3/1998 Meiring et al.
5,730,158 A 3/1998 Collins et al.
5,750,964 A 5/1998 Counts et al.
5,799,663 A 9/1998 Gross et al.
5,816,263 A 10/1998 Counts et al.
5,819,756 A 10/1998 Mielordt
5,829,453 A 11/1998 White et al.
5,865,185 A 2/1999 Collins et al.
5,865,186 A 2/1999 Volsey, II
5,878,752 A 3/1999 Adams et al.
5,880,439 A 3/1999 Deevi et al.
5,894,841 A 4/1999 Voges
5,915,387 A 7/1999 Baggett, Jr. et al.
5,934,289 A 8/1999 Watkins et al.
5,954,979 A 9/1999 Counts et al.
5,967,148 A 10/1999 Harris et al.
6,026,820 A 2/2000 Baggett, Jr. et al.
6,033,623 A 3/2000 Deevi et al.
6,040,560 A 3/2000 Fleischhauer et al.
6,053,176 A 4/2000 Adams et al.
6,089,857 A 7/2000 Matsuura et al.
6,095,153 A 8/2000 Kessler et al.

(56) References Cited

U.S. PATENT DOCUMENTS 6,116,247 A 9/2000 Banyasz et al.
6,119,700 A 9/2000 Fleischhauer et al.
6,125,853 A 10/2000 Susa et al.
6,125,855 A 10/2000 Nevett et al.
6,125,866 A 10/2000 Nichols et al.
6,155,268 A 12/2000 Takeuchi
6,164,287 A 12/2000 White
6,182,670 B1 2/2001 White
6,196,218 B1 3/2001 Voges
6,196,219 B1 3/2001 Hess et al.
6,216,706 B1 4/2001 Kumar et al.
6,289,898 B1 9/2001 Fournier et al.
6,349,729 B1 2/2002 Pham
6,357,671 B1 3/2002 Cewers
6,418,938 B1 7/2002 Fleischhauer et al.
6,446,426 B1 8/2002 Sweeney et al.
6,532,965 B1 3/2003 Abhulimen et al.
6,598,607 B2 7/2003 Adiga et al.
6,601,776 B1 8/2003 Oljaca et al.
6,615,840 B1 9/2003 Fournier et al.
6,688,313 B2 2/2004 Wrenn et al.
6,701,936 B2 3/2004 Shafer et al.
6,715,494 B1 4/2004 McCoy
6,730,832 B1 5/2004 Dominguez et al.
6,772,756 B2 8/2004 Shayan
6,803,545 B2 10/2004 Blake et al.
6,803,550 B2 10/2004 Sharpe et al.
6,810,883 B2 11/2004 Felter et al.
6,854,461 B2 2/2005 Nichols
6,854,470 B1 2/2005 Pu
6,994,096 B2 2/2006 Rostami et al.
7,011,096 B2 3/2006 Li et al.
7,017,585 B2 3/2006 Li et al.
7,025,066 B2 4/2006 Lawson et al.
7,117,867 B2 10/2006 Cox et al.
7,163,015 B2 1/2007 Moffitt
7,173,322 B2 2/2007 Cox et al.
7,185,659 B2 3/2007 Sharpe et al.
7,234,470 B2 6/2007 Yang
7,290,549 B2 11/2007 Banerjee et al.
7,293,565 B2 11/2007 Griffin et al.
7,392,809 B2 7/2008 Larson et al.
7,513,253 B2 4/2009 Kobayashi et al.
7,647,932 B2 1/2010 Cantrell et al.
7,690,385 B2 4/2010 Moffitt
7,692,123 B2 4/2010 Baba et al.
7,726,320 B2 6/2010 Robinson et al.
7,775,459 B2 8/2010 Martens, III et al.
7,810,505 B2 10/2010 Yang
7,832,410 B2 11/2010 Hon
7,845,359 B2 12/2010 Montaser
7,878,209 B2 2/2011 Newbery et al.
7,896,006 B2 3/2011 Hamano et al.
8,066,010 B2 11/2011 Newbery et al.
8,079,371 B2 12/2011 Robinson et al.
8,127,772 B2 3/2012 Montaser
8,156,944 B2 4/2012 Han
8,314,591 B2 11/2012 Terry et al.
8,365,742 B2 2/2013 Hon
8,375,957 B2 2/2013 Hon
8,393,331 B2 3/2013 Hon
8,402,976 B2 3/2013 Fernando et al.
8,499,766 B1 8/2013 Newton
8,528,569 B1 9/2013 Newton
8,550,069 B2 10/2013 Alelov
2002/0146242 A1 10/2002 Vieira
2003/0131859 A1 7/2003 Li et al.
2003/0226837 A1 12/2003 Blake et al.
2004/0020500 A1 2/2004 Wrenn et al.
2004/0118401 A1 6/2004 Smith et al.
2004/0129280 A1 7/2004 Woodson et al.
2004/0149296 A1 8/2004 Rostami et al.
2004/0200488 A1 10/2004 Felter et al.
2004/0224435 A1 11/2004 Shibata et al.
2004/0226568 A1 11/2004 Takeuchi et al.
2004/0255965 A1 12/2004 Perfetti et al.
2005/0016549 A1 1/2005 Banerjee et al.
2005/0016550 A1 1/2005 Katase
2005/0066986 A1 3/2005 Nestor et al.
2005/0151126 A1 7/2005 Yamakawa et al.
2005/0172976 A1 8/2005 Newman et al.
2005/0274390 A1 12/2005 Banerjee et al.
2006/0016453 A1 1/2006 Kim
2006/0032501 A1 2/2006 Hale et al.
2006/0070633 A1 4/2006 Rostami et al.
2006/0162733 A1 7/2006 McGrath et al.
2006/0185687 A1 8/2006 Hearn et al.
2006/0196518 A1 9/2006 Hon
2007/0074734 A1 4/2007 Braunshteyn et al.
2007/0102013 A1 5/2007 Adams et al.
2007/0215167 A1 9/2007 Crooks et al.
2007/0283972 A1 12/2007 Monsees et al.
2008/0085103 A1 4/2008 Beland et al.
2008/0092912 A1 4/2008 Robinson et al.
2008/0149118 A1 6/2008 Oglesby et al.
2008/0245377 A1 10/2008 Marshall et al.
2008/0257367 A1 10/2008 Paterno et al.
2008/0276947 A1 11/2008 Martzel
2008/0302374 A1 12/2008 Wengert et al.
2009/0065010 A1 3/2009 Shands
2009/0095311 A1 4/2009 Hon
2009/0095312 A1 4/2009 Herbrich et al.
2009/0126745 A1 5/2009 Hon
2009/0188490 A1 7/2009 Hon
2009/0230117 A1 9/2009 Fernando et al.
2009/0260641 A1 10/2009 Monsees et al.
2009/0260642 A1 10/2009 Monsees et al.
2009/0272379 A1 11/2009 Thorens et al.
2009/0283103 A1 11/2009 Nielsen et al.
2009/0293892 A1 12/2009 Williams et al.
2009/0320863 A1 12/2009 Fernando et al.
2009/0324206 A1 12/2009 Young et al.
2010/0006113 A1 1/2010 Urtsev et al.
2010/0024834 A1 2/2010 Oglesby et al.
2010/0043809 A1 2/2010 Magnon
2010/0059070 A1 3/2010 Potter et al.
2010/0059073 A1 3/2010 Hoffmann et al.
2010/0065075 A1 3/2010 Banerjee et al.
2010/0083959 A1 4/2010 Siller
2010/0163063 A1 7/2010 Fernando et al.
2010/0200006 A1 8/2010 Robinson et al.
2010/0229881 A1 9/2010 Hearn
2010/0242974 A1 9/2010 Pan
2010/0242976 A1 9/2010 Katayama et al.
2010/0258139 A1 10/2010 Onishi et al.
2010/0300467 A1 12/2010 Kuistilla et al.
2010/0307518 A1 12/2010 Wang
2010/0313901 A1 12/2010 Fernando et al.
2011/0005535 A1 1/2011 Xiu
2011/0011396 A1 1/2011 Fang
2011/0036363 A1 2/2011 Urtsev et al.
2011/0036365 A1 2/2011 Chong et al.
2011/0073121 A1 3/2011 Levin et al.
2011/0088707 A1 4/2011 Hajaligol
2011/0094523 A1 4/2011 Thorens et al.
2011/0120480 A1 5/2011 Brenneise
2011/0126847 A1 6/2011 Zuber et al.
2011/0126848 A1 6/2011 Zuber et al.
2011/0155153 A1 6/2011 Thorens et al.
2011/0155718 A1 6/2011 Greim et al.
2011/0162663 A1 7/2011 Bryman
2011/0168194 A1 7/2011 Hon
2011/0180082 A1 7/2011 Banerjee et al.
2011/0265806 A1 11/2011 Alarcon et al.
2011/0309157 A1 12/2011 Yang et al.
2012/0042885 A1 2/2012 Stone et al.
2012/0060853 A1 3/2012 Robinson et al.
2012/0111347 A1 5/2012 Hon
2012/0132643 A1 5/2012 Choi et al.
2012/0227752 A1 9/2012 Alelov
2012/0231464 A1 9/2012 Yu et al.
2012/0260927 A1 10/2012 Liu
2012/0279512 A1 11/2012 Hon
2012/0318882 A1 12/2012 Abehasera

(56) References Cited

U.S. PATENT DOCUMENTS

| | | | |
|---|---|---|---|
| 2013/0037041 | A1 | 2/2013 | Worm et al. |
| 2013/0056013 | A1 | 3/2013 | Terry et al. |
| 2013/0081625 | A1 | 4/2013 | Rustad et al. |
| 2013/0081642 | A1 | 4/2013 | Safari |
| 2013/0192619 | A1 | 8/2013 | Tucker et al. |
| 2013/0255702 | A1 | 10/2013 | Griffith, Jr. et al. |
| 2013/0306084 | A1 | 11/2013 | Flick |
| 2013/0319439 | A1 | 12/2013 | Gorelick et al. |
| 2013/0340750 | A1 | 12/2013 | Thorens et al. |
| 2013/0340775 | A1 | 12/2013 | Juster et al. |
| 2014/0060554 | A1 | 3/2014 | Collett et al. |
| 2014/0060555 | A1 | 3/2014 | Chang et al. |
| 2014/0069424 | A1 | 3/2014 | Poston et al. |
| 2014/0096781 | A1 | 4/2014 | Sears et al. |
| 2014/0096782 | A1 | 4/2014 | Ampolini et al. |
| 2014/0373856 | A1 | 12/2014 | Zuber et al. |

FOREIGN PATENT DOCUMENTS

| | | |
|---|---|---|
| CA | 2 752 255 | 8/2010 |
| CN | 1541577 | 11/2004 |
| CN | 2719043 | 8/2005 |
| CN | 200997909 | 1/2008 |
| CN | 101116542 | 2/2008 |
| CN | 101176805 | 5/2008 |
| CN | 201379072 | 1/2010 |
| DE | 10 2006 004 484 | 8/2007 |
| DE | 102006041042 | 3/2008 |
| DE | 20 2009 010 400 | 11/2009 |
| EP | 0 295 122 | 12/1988 |
| EP | 0 430 566 | 6/1991 |
| EP | 0 845 220 | 6/1998 |
| EP | 1 618 803 | 1/2006 |
| EP | 2 316 286 | 5/2011 |
| EP | 2 468 118 | 6/2012 |
| GB | 1444461 | 7/1976 |
| GB | 2469850 | 11/2010 |
| WO | WO 1986/02528 | 5/1986 |
| WO | WO 1997/48293 | 12/1997 |
| WO | WO 02/37990 | 5/2002 |
| WO | WO 2004/043175 | 5/2004 |
| WO | WO 2005/099494 | 10/2005 |
| WO | WO 2007/078273 | 7/2007 |
| WO | WO 2007/131449 | 11/2007 |
| WO | WO 2009/105919 | 9/2009 |
| WO | WO 2009/155734 | 12/2009 |
| WO | WO 2010/003480 | 1/2010 |
| WO | WO 2010/045670 | 4/2010 |
| WO | WO 2010/073122 | 7/2010 |
| WO | WO 2010/091593 | 8/2010 |
| WO | WO 2010/118644 | 10/2010 |
| WO | WO 2010/140937 | 12/2010 |
| WO | WO 2011/010334 | 1/2011 |
| WO | WO 2011/081558 | 7/2011 |
| WO | WO 2012/072762 | 6/2012 |
| WO | WO 2012/100523 | 8/2012 |
| WO | WO 2013/089551 | 6/2013 |
| WO | WO 2013/098409 | 7/2013 |

METHOD OF PREPARING AN AEROSOL DELIVERY DEVICE

FIELD OF THE DISCLOSURE

The present disclosure relates to aerosol delivery devices such as smoking articles, and more particularly to aerosol delivery devices that may utilize electrically generated heat for the production of aerosol (e.g., smoking articles commonly referred to as electronic cigarettes). The smoking articles may be configured to heat an aerosol precursor, which may incorporate materials that may be made or derived from tobacco or otherwise incorporate tobacco, the precursor being capable of forming an inhalable substance for human consumption.

BACKGROUND

Many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices, and heat generating sources set forth in the background art described in U.S. Pat. No. 7,726,320 to Robinson et al., U.S. Pat. Pub. No. 2013/0255702 to Griffith Jr. et al., and U.S. patent application Ser. No. 13/647,000 to Sears et al., filed Oct. 8, 2012, which are incorporated herein by reference in their entirety. See also, for example, the various types of smoking articles, aerosol delivery devices, and electrically powered heat generating sources referenced by brand name and commercial source in U.S. patent application Ser. No. 14/170,838 to Bless et al., filed Feb. 3, 2014, which is incorporated herein by reference in its entirety.

It would be desirable to provide a reservoir for an aerosol precursor composition for use in an aerosol delivery device, the reservoir being provided so as to improve formation of the aerosol delivery device. It would also be desirable to provide aerosol delivery devices that are prepared utilizing such reservoirs.

SUMMARY OF THE DISCLOSURE

The present disclosure relates to aerosol delivery devices, methods of forming such devices, and elements of such devices. In some embodiments, the present disclosure provides methods of forming an aerosol delivery device. Such methods can comprise, for example, providing a fibrous substrate; providing a shell; wetting the fibrous substrate with a wetting liquid; and inserting the wetted fibrous substrate into the shell. Preferably, after the inserting step, the shell further comprises one or more of a heater, a liquid transport element, and an electrical connection.

In various embodiments, the present methods can be defined by one or more of the following statements. Specifically, a method as described above may include one, two, or any number of the following characteristics in any combination.

The fibrous substrate can have a maximum liquid retention capacity, and the mass of liquid in the wetted fibrous substrate when inserted into the shell can be less than 75% of the maximum retention capacity.

The shell can have a defined cross-sectional shape, and the method can comprise configuring the wetted fibrous substrate into a shape that substantially corresponds to the cross-sectional shape of the shell.

The shell can be substantially cylindrical, the wetted fibrous substrate can be flat, and the method can comprise configuring the flat, wetted fibrous substrate to be substantially cylindrical.

The method can comprise wrapping the wetted fibrous substrate around a support such that opposing ends of the wetted fibrous substrate overlap or substantially abut.

The method can comprise removing at least a portion of the liquid from the wetted fibrous substrate prior to inserting the wetted fibrous substrate into the shell.

The step of removing at least a portion of the liquid can comprise applying pressure to the wetted fibrous substrate.

The step of applying pressure can comprise passing the wetted fibrous substrate through one or more sets of rollers.

The method can comprise removing at least 25% by weight of the liquid from the wetted fibrous substrate.

The fibrous substrate prior to the wetting step can have a first thickness, and after the step of removing at least a portion of the liquid, the wetted fibrous substrate can have a second thickness that is less than the first thickness by at least 5%.

The method can comprise adding an aerosol precursor composition to the fibrous substrate after the fibrous substrate has been inserted into the shell.

The aerosol precursor composition can have at least one component in common with the wetting liquid.

The fibrous substrate can be a nonwoven material.

The fibrous substrate can comprise cellulose acetate.

In an exemplary embodiment, the method can comprise providing the fibrous substrate; providing the liquid transport element with the heater in communication therewith; providing the shell; wetting the fibrous substrate with the wetting liquid; wrapping the wetted fibrous substrate around at least a portion of the liquid transport element; and inserting the wetted fibrous substrate in combination with the liquid transport element and the heater into the shell so that the heater is positioned beyond an end of the wetted fibrous substrate.

In some embodiments, the present disclosure can provide a method for adding an aerosol precursor composition to an aerosol delivery device. For example such method can comprise: providing a fibrous substrate and a shell of the aerosol delivery device; adding at least a portion of at least one component of the aerosol precursor composition to the fibrous substrate prior to combining the fibrous substrate with the shell; and adding the remainder of the aerosol precursor composition to the fibrous substrate after combining the fibrous substrate with the shell. In some embodiments, the aerosol precursor composition can comprise water, for example, and the method can comprise adding all or a portion of the water to the fibrous substrate prior to combining the fibrous substrate with the shell.

In some embodiments, the present disclosure further provides an input configured for insertion into a housing or shell of an aerosol delivery device. In particular, such input can comprise a liquid transport element; a heater in a heating arrangement with the liquid transport element; and a wetted fibrous substrate wrapped around at least a portion of the liquid transport element. In particular embodiments, the wetted fibrous substrate can have an inner surface in a wicking arrangement with the liquid transport element and can have an outer surface having a maximum diameter that substantially corresponds to the diameter of an inner surface of the aerosol delivery device housing. In some embodiments, the fibrous substrate can have a maximum liquid retention capacity, and the mass of liquid in the wetted fibrous substrate can be less than 75% of the maximum retention capacity. In some embodiments, the fibrous substrate can comprise cellulose acetate. In some embodiments, the maximum diameter of the outer surface of the wetted substrate can be less than the diameter of the inner surface of the aerosol delivery device housing by about 0.5% to about 10%. In some embodiments, the heater extends beyond an end of the wetted fibrous substrate.

BRIEF DESCRIPTION OF THE FIGURES

Figure 1:
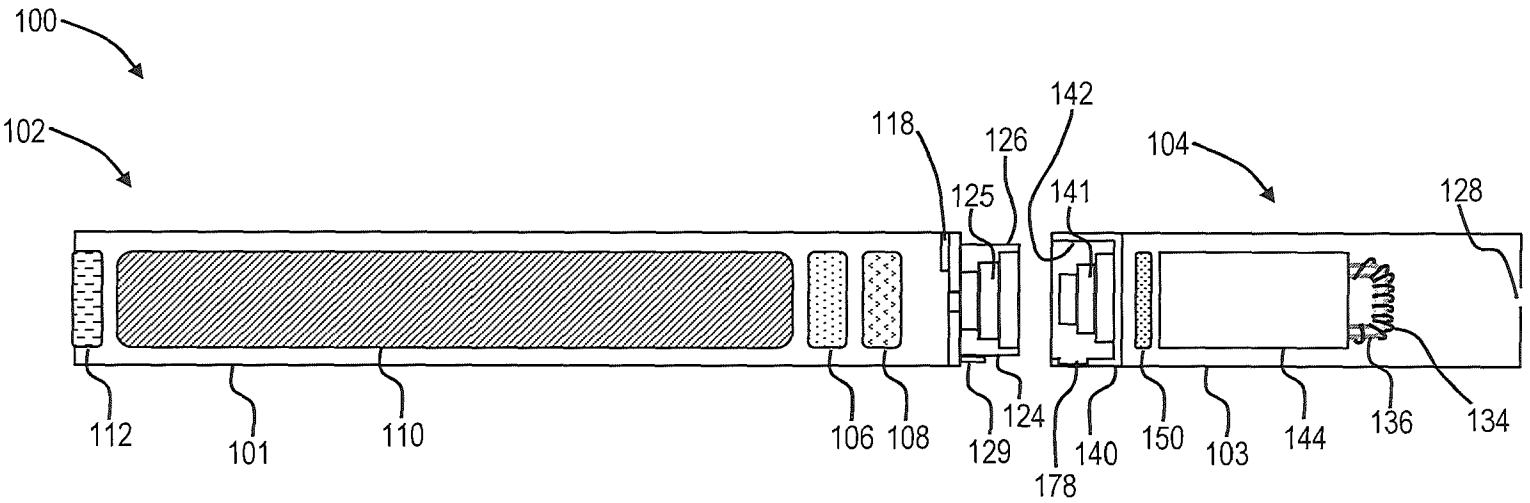
Figure 2:
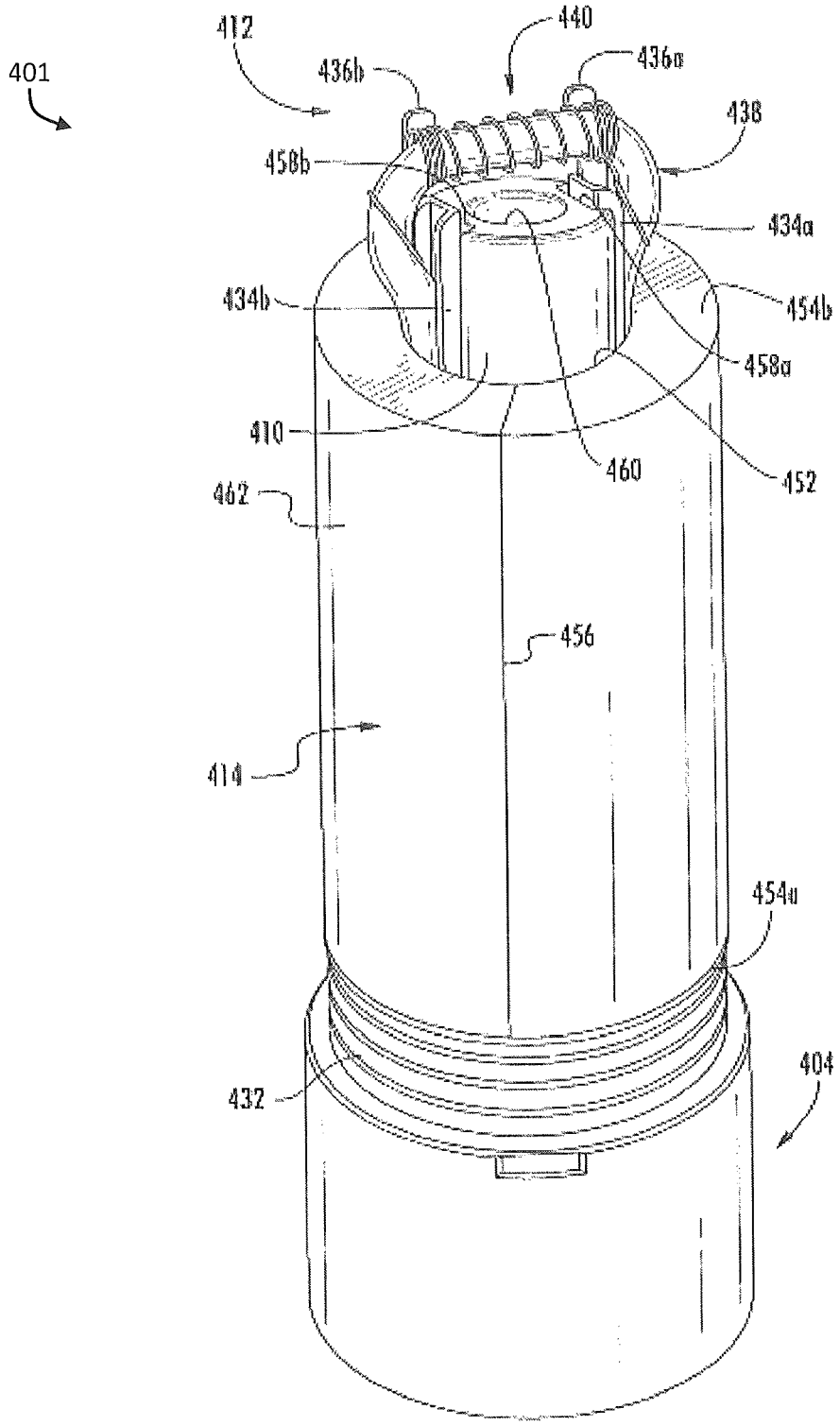
Figure 3:
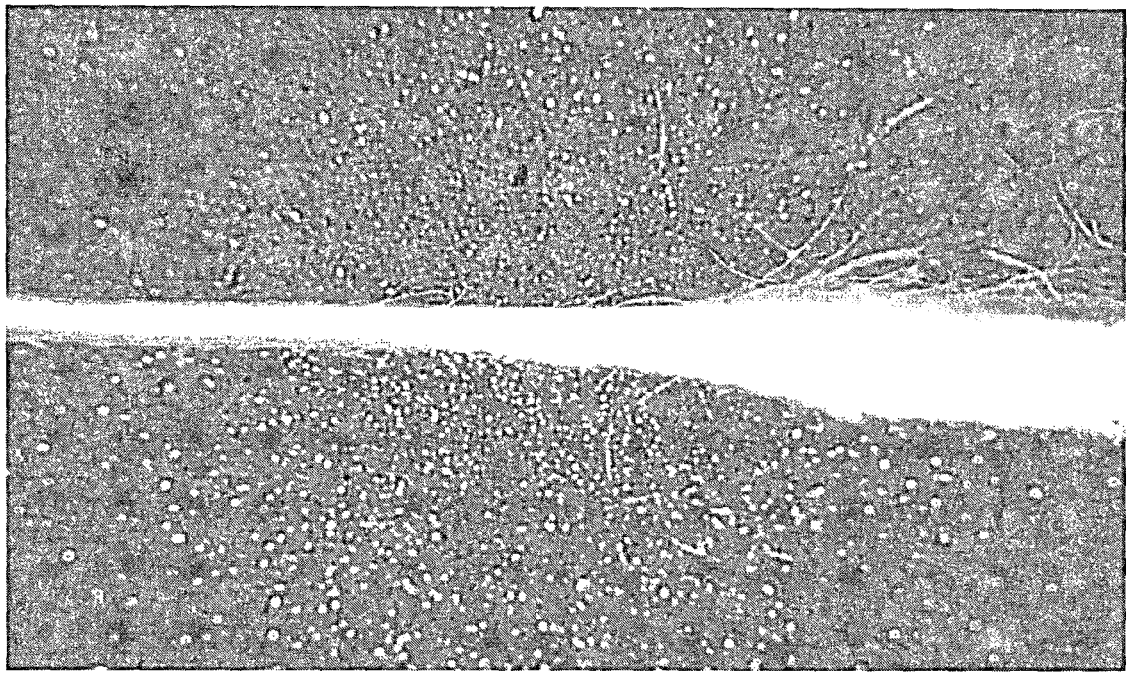
Figure 4:
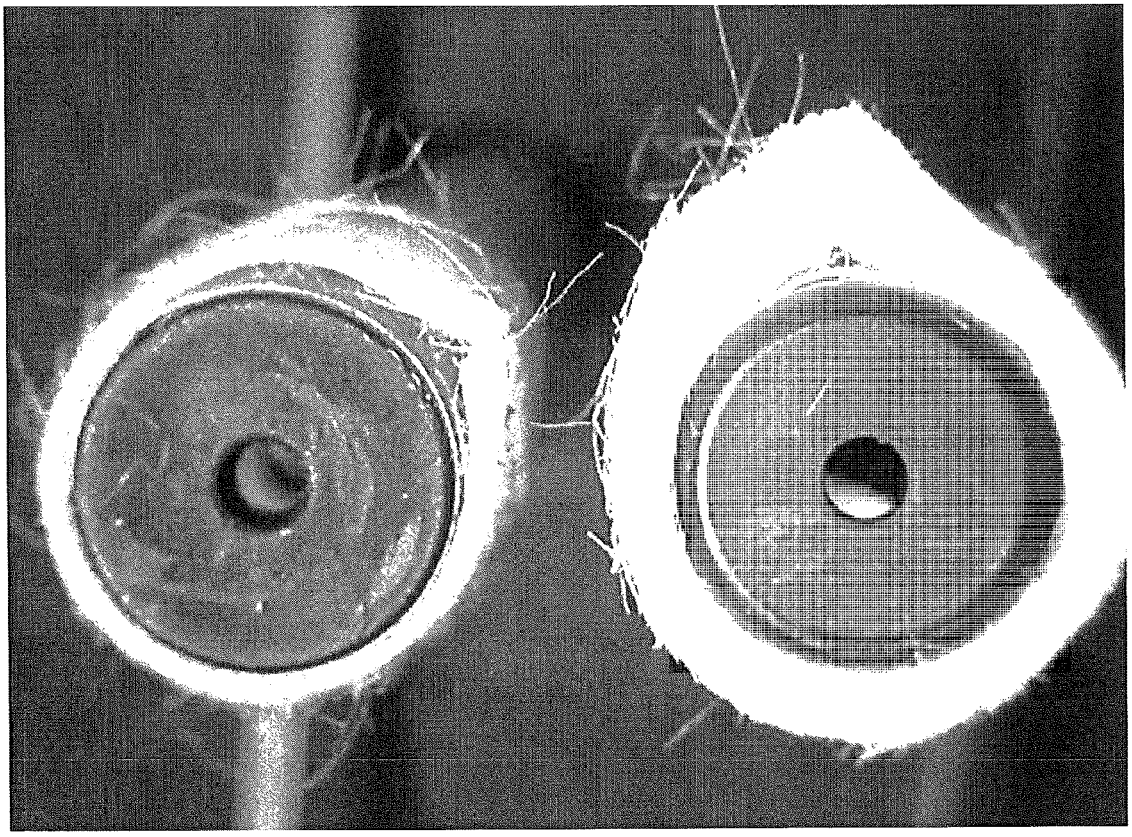

Having thus described the disclosure in the foregoing general terms, reference will now be made to the accompanying drawings, which are not necessarily drawn to scale, and wherein:

FIG. 1 is a partially cut-away view of an aerosol delivery device comprising a cartridge and a control body according to an example embodiment of the present disclosure;

FIG. 2 is perspective view of an input according to an example embodiment of the present disclosure;

FIG. 3 is an illustration of a fibrous substrate showing an unprocessed portion and a portion that has been processed according to an example embodiment of the present disclosure; and FIG. 4 is an illustration of a fibrous substrate that has been processed according to an example embodiment of the present disclosure also wrapped around a mandrel and an unprocessed fibrous substrate also wrapped around a mandrel.

DETAILED DESCRIPTION

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

As described hereinafter, embodiments of the present disclosure relate to aerosol delivery systems. Aerosol delivery systems according to the present disclosure use electrical energy to heat a material (preferably without combusting the material to any significant degree) to form an inhalable substance; and components of such systems have the form of articles most preferably are sufficiently compact to be considered hand-held devices. That is, use of components of preferred aerosol delivery systems does not result in the production of smoke in the sense that aerosol results principally from by-products of combustion or pyrolysis of tobacco, but rather, use of those preferred systems results in the production of vapors resulting from volatilization or vaporization of certain components incorporated therein. In preferred embodiments, components of aerosol delivery systems may be characterized as electronic cigarettes, and those electronic cigarettes most preferably incorporate tobacco and/or components derived from tobacco, and hence deliver tobacco derived components in aerosol form.

Aerosol generating pieces of certain preferred aerosol delivery systems may provide many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe that is employed by lighting and burning tobacco (and hence inhaling tobacco smoke), without any substantial degree of combustion of any component thereof. For example, the user of an aerosol generating piece of the present disclosure can hold and use that piece much like a smoker employs a traditional type of smoking article, draw on one end of that piece for inhalation of aerosol produced by that piece, take or draw puffs at selected intervals of time, and the like.

Aerosol delivery devices of the present disclosure also can be characterized as being vapor-producing articles or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered to be smoke-like.

Aerosol delivery devices of the present disclosure generally include a number of components provided within an outer body or shell, which may be referred to as a housing. The overall design of the outer body or shell can vary, and the format or configuration of the outer body that can define the overall size and shape of the aerosol delivery device can vary. Typically, an elongated body resembling the shape of a cigarette or cigar can be a formed from a single, unitary housing, or the elongated housing can be formed of two or more separable bodies. For example, an aerosol delivery device can comprise an elongated shell or body that can be substantially tubular in shape and, as such, resemble the shape of a conventional cigarette or cigar. In one embodiment, all of the components of the aerosol delivery device are contained within one housing. Alternatively, an aerosol delivery device can comprise two or more housings that are joined and are separable. For example, an aerosol delivery device can possess at one end a control body comprising a housing containing one or more reusable components (e.g., a rechargeable battery and various electronics for controlling the operation of that article), and at the other end and removably attached thereto an outer body or shell containing a disposable portion (e.g., a disposable flavor-containing cartridge).

Aerosol delivery devices of the present disclosure most preferably comprise some combination of a power source (i.e., an electrical power source), at least one control component (e.g., means for actuating, controlling, regulating and ceasing power for heat generation, such as by controlling electrical current flow the power source to other components of the article—e.g., a microcontroller or microprocessor), a heater or heat generation member (e.g., an electrical resistance heating element or other component, which alone or in combination with one or more further elements may be commonly referred to as an "atomizer"), an aerosol precursor composition (e.g., commonly a liquid capable of yielding an aerosol upon application of sufficient heat, such as ingredients commonly referred to as "smoke juice," "e-liquid" and "e-juice"), and a mouthend region or tip for allowing draw upon the aerosol delivery device for aerosol inhalation (e.g., a defined airflow path through the article such that aerosol generated can be withdrawn therefrom upon draw).

More specific formats, configurations and arrangements of components within the aerosol delivery systems of the present disclosure will be evident in light of the further disclosure provided hereinafter. Additionally, the selection and arrangement of various aerosol delivery system components can be appreciated upon consideration of the commercially available electronic aerosol delivery devices, such as those representative products referenced in background art section of the present disclosure.

In various embodiments, an aerosol delivery device can comprise a reservoir configured to retain the aerosol precursor composition. The reservoir particularly can be formed of a fibrous material and thus may be referred to as a fibrous substrate.

A fibrous substrate useful as a reservoir in an aerosol delivery device can be a woven or nonwoven material formed of a plurality of fibers or filaments and can be formed of one or both of natural fibers and synthetic fibers. For example, a fibrous substrate may comprise a fiberglass material. In particular embodiments, a cellulose acetate material can be used.

Fibrous substrates can be particularly useful in light of their high retention capacity for an aerosol precursor composition. For example, a cellulose acetate substrate useful according to the present disclosure can have a maximum retention capacity relative to an aerosol precursor composition as described herein that is at least 100%, at least 150%, at least 200%, or at least 300% of the dry mass of the fibrous substrate. Other materials useful as a fibrous substrate can exhibit like retention capacities. Exemplary retention capacities of a cellulose acetate substrate are provided in the examples provided herein.

A fibrous substrate useful as a reservoir may be defined in relation to its maximum liquid retention capacity. It is understood that maximum retention capacity is relative to the nature of the material used as well as the dry weight and dimensions of the substrate. The present disclosure may relate various embodiments to a substrate that is wetted with a liquid, and the mass of the liquid in the wetted substrate can be described in relation to the percentage of the maximum retention capacity. For example, a fibrous substrate may be wetted with a mass of liquid that is less than 75%, less than 50%, less than 25%, or less than 10% of the maximum retention capacity. Since the mass of liquid in the wetted fibrous substrate is relative to the maximum liquid retention capacity of the fibrous substrate, the actual value of the maximum liquid retention capacity is not necessary to the understanding of the disclosure.

While fibrous substrates can be particularly useful in forming an aerosol delivery device, such fibrous substrates can be difficult to assemble into a housing or shell of the aerosol delivery device. In particular, nonwoven fibrous substrates can have loose fibers along surfaces and edges thereof, and such loose fibers can increase snagging of the substrate on the open end of the shell and/or on a further element of the aerosol delivery device. This can result in the substrate being pulled apart or otherwise made unusable. Likewise, the loose ends may cause the fibrous substrate to be of greater dimension that may be desired. For example, in some embodiments, it can be useful for a heater element to extend beyond an end of the fibrous reservoir, and the loose fibers of the substrate may cause the substrate to "fluff" and thus undesirably extend beyond the position of the heater element.

In some embodiments, a fibrous substrate may be wrapped, such as into a substantially cylindrical shape, and the ends of the substrate may overlap or abut. The so-formed joint can have a propensity for buckling, and the buckled section may sufficiently increase the dimensions of the substrate so that it can no longer be inserted into the aerosol delivery device housing.

The present disclosure provides methods of assembling an aerosol delivery device that can overcome one or more of the above problems. The methods can be used in forming a variety of aerosol delivery devices, and the formed devices can take on a variety of conformations.

One example embodiment of an aerosol delivery device 100 that can be prepared according to the present disclosure is provided in FIG. 1. As seen in the cut-away view illustrated therein, the aerosol delivery device 100 can comprise a control body 102 and a cartridge 104 that can be permanently or detachably aligned in a functioning relationship. Engagement of the control body 102 and the cartridge 104 can be press fit (as illustrated), threaded, interference fit, magnetic, or the like. In particular, connection components, such as further described herein may be used. For example, the control body may include a coupler that is adapted to engage a connector on the cartridge.

In specific embodiments, one or both of the control body 102 and the cartridge 104 may be referred to as being disposable or as being reusable. For example, the control body may have a replaceable battery or a rechargeable battery and thus may be combined with any type of recharging technology, including connection to a typical electrical outlet, connection to a car charger (i.e., cigarette lighter receptacle), and connection to a computer, such as through a universal serial bus (USB) cable. For example, an adaptor including a USB connector at one end and a control body connector at an opposing end is disclosed in U.S. patent application Ser. No. 13/840,264 to Novak et al., filed Mar. 15, 2013, which is incorporated herein by reference in its entirety. Further, in some embodiments the cartridge may comprise a single-use cartridge, as disclosed in U.S. patent application Ser. No. 13/603,612 to Chang et al., filed Sep. 5, 2012, which is incorporated herein by reference in its entirety.

As illustrated in FIG. 1, a control body 102 can be formed of a control body shell 101 that can include a control component 106 (e.g., a microcontroller), a flow sensor 108, a battery 110, and an LED 112, and such components can be variably aligned. Further indicators (e.g., a haptic feedback component, an audio feedback component, or the like) can be included in addition to or as an alternative to the LED. A cartridge 104 can be formed of a cartridge shell 103 enclosing the reservoir 144 that is in fluid communication with a liquid transport element 136 adapted to wick or otherwise transport an aerosol precursor composition stored in the reservoir housing to a heater 134. Various embodiments of materials configured to produce heat when electrical current is applied therethrough may be employed to form the resistive heating element 134. Example materials from which the wire coil may be formed include Kanthal (FeCrAl), Nichrome, Molybdenum disilicide ($MoSi_2$), molybdenum silicide (MoSi), Molybdenum disilicide doped with Aluminum ($Mo(Si,Al)_2$), graphite and graphite-based materials (e.g., carbon-based foams and yarns) and ceramics (e.g., positive or negative temperature coefficient ceramics).

An opening 128 may be present in the cartridge shell 103 (e.g., at the mouthend) to allow for egress of formed aerosol from the cartridge 104. Such components are representative of the components that may be present in a cartridge and are not intended to limit the scope of cartridge components that are encompassed by the present disclosure.

The cartridge 104 also may include one or more electronic components 150, which may include an integrated circuit, a memory component, a sensor, or the like. The electronic component 150 may be adapted to communicate with the control component 106 and/or with an external device by wired or wireless means. The electronic component 150 may be positioned anywhere within the cartridge 104 or its base 140.

Although the control component 106 and the flow sensor 108 are illustrated separately, it is understood that the control component and the flow sensor may be combined as an electronic circuit board with the air flow sensor attached directly thereto. Further, the electronic circuit board may be positioned horizontally relative the illustration of FIG. 1 in that the electronic circuit board can be lengthwise parallel to the central axis of the control body. In some embodiments, the air flow sensor may comprise its own circuit board or other base element to which it can be attached.

The control body 102 and the cartridge 104 may include components adapted to facilitate a fluid engagement therebetween. As illustrated in FIG. 1, the control body 102 can include a coupler 124 having a cavity 125 therein. The cartridge 104 can include a base 140 adapted to engage the coupler 124 and can include a projection 141 adapted to fit within the cavity 125. Such engagement can facilitate a stable connection between the control body 102 and the cartridge 104 as well as establish an electrical connection between the battery 110 and control component 106 in the control body and the heater 134 in the cartridge. Further, the control body shell 101 can include an air intake 118, which may be a notch in the shell where it connects to the coupler 124 that allows for passage of ambient air around the coupler and into the shell where it then passes through the cavity 125 of the coupler and into the cartridge through the projection 141.

A coupler and a base useful according to the present disclosure are described in U.S. patent application Ser. No. 13/840,264 to Novak et al., filed Mar. 15, 2013, the disclosure of which is incorporated herein by reference in its entirety. For example, a coupler as seen in FIG. 1 may define an outer periphery 126 configured to mate with an inner periphery 142 of the base 140. In one embodiment the inner periphery of the base may define a radius that is substantially equal to, or slightly greater than, a radius of the outer periphery of the coupler. Further, the coupler 124 may define one or more protrusions 129 at the outer periphery 126 configured to engage one or more recesses 178 defined at the inner periphery of the base. However, various other embodiments of structures, shapes, and components may be employed to couple the base to the coupler. In some embodiments the connection between the base 140 of the cartridge 104 and the coupler 124 of the control body 102 may be substantially permanent, whereas in other embodiments the connection therebetween may be releasable such that, for example, the control body may be reused with one or more additional cartridges that may be disposable and/or refillable.

The aerosol delivery device 100 may be substantially rod-like or substantially tubular shaped or substantially cylindrically shaped in some embodiments. In other embodiments, further shapes and dimensions are encompassed—e.g., a rectangular or triangular cross-section, or the like.

The reservoir 144 illustrated in FIG. 1 can be a container or can be a fibrous reservoir, as presently described. For example, the reservoir 144 can comprise one or more layers of nonwoven fibers substantially formed into the shape of a tube encircling the interior of the cartridge shell 103, in this embodiment. An aerosol precursor composition can be retained in the reservoir 144. Liquid components, for example, can be sorptively retained by the reservoir 144. The reservoir 144 can be in fluid connection with a liquid transport element 136. The liquid transport element 136 can transport the aerosol precursor composition stored in the reservoir 144 via capillary action to the heating element 134 that is in the form of a metal wire coil in this embodiment. As such, the heating element 134 is in a heating arrangement with the liquid transport element 136.

In use, when a user draws on the article 100, airflow is detected by the sensor 108, the heating element 134 is activated, and the components for the aerosol precursor composition are vaporized by the heating element 134. Drawing upon the mouthend of the article 100 causes ambient air to enter the air intake 118 and pass through the cavity 125 in the coupler 124 and the central opening in the projection 141 of the base 140. In the cartridge 104, the drawn air combines with the formed vapor to form an aerosol. The aerosol is whisked away from the heating element 134 and out the mouth opening 128 in the mouthend of the article 100.

The various components of an aerosol delivery device according to the present disclosure can be chosen from components described in the art and commercially available. Examples of batteries that can be used according to the disclosure are described in U.S. Pat. App. Pub. No. 2010/0028766 to Peckerar et al., the disclosure of which is incorporated herein by reference in its entirety.

The aerosol delivery device can incorporate a sensor or detector for control of supply of electric power to the heat generation element when aerosol generation is desired (e.g., upon draw during use). As such, for example, there is provided a manner or method for turning off the power supply to the heat generation element when the aerosol delivery device is not be drawn upon during use, and for turning on the power supply to actuate or trigger the generation of heat by the heat generation element during draw. Additional representative types of sensing or detection mechanisms, structure and configuration thereof, components thereof, and general methods of operation thereof, are described in U.S. Pat. No. 5,261,424 to Sprinkel, Jr.; U.S. Pat. No. 5,372,148 to McCafferty et al.; and PCT WO 2010/003480 by Flick; which are incorporated herein by reference.

The aerosol delivery device most preferably incorporates a control mechanism for controlling the amount of electric power to the heat generation element during draw. Representative types of electronic components, structure and configuration thereof, features thereof, and general methods of operation thereof, are described in U.S. Pat. No. 4,735,217 to Gerth et al.; U.S. Pat. No. 4,947,874 to Brooks et al.; U.S. Pat. No. 5,372,148 to McCafferty et al.; U.S. Pat. No. 6,040,560 to Fleischhauer et al.; U.S. Pat. No. 7,040,314 to Nguyen et al, and U.S. Pat. No. 8,205,622 to Pan; U.S. Pat. Pub. Nos. 2009/0230117 to Fernando et al. and 2014/0060554 to Collet et al.; and U.S. patent application Ser. No. 13/837,542, filed Mar. 15, 2013, to Ampolini et al. and Ser.

No. 14/209,191, filed Mar. 13, 2014, to Henry et al.; which are incorporated herein by reference.

Representative types of substrates, reservoirs or other components for supporting the aerosol precursor are described in U.S. Pat. No. 8,528,569 to Newton; and U.S. patent application Ser. No. 13/802,950, filed Mar. 15, 2013, to Chapman et al.; Ser. No. 14/011,192, filed Aug. 28, 2013, to Davis et al. and Ser. No. 14/170,838, filed Feb. 3, 2014, to Bless et al.; which are incorporated herein by reference. Additionally, various wicking materials, and the configuration and operation of those wicking materials within certain types of electronic cigarettes, are set forth in U.S. patent application Ser. No. 13/754,324, filed Jan. 30, 2013, to Sears et al.; which is incorporated herein by reference.

In some embodiments, the present disclosure provides methods of forming an aerosol delivery device. The device may comprise a single housing or shell that may include all components of the aerosol delivery device. The method may relate to forming, for example, a cartridge that includes a shell and internal components as described above, and the cartridge may be configured for attachment to a separately formed control body. The method of preparation described herein thus may be applied to embodiments formed of a single housing or embodiments formed of a plurality of housings.

In some embodiments, the method can comprise providing a fibrous substrate, which can be formed of a material as discussed above. The method further can comprise providing a shell, which can be formed of metal, plastic, paper, wood, or the like. The method also can comprise wetting the fibrous substrate with a wetting liquid and inserting the wetted fibrous substrate into the shell. As the reservoir can be combined with further elements as described above, after the inserting step, the shell further can comprise one or more of a heater, a liquid transport element, and an electrical connection.

It has been found according to the present disclosure that the problems arising with assembly with a fibrous substrate can be at least partially overcome by wetting the fibrous reservoir substrate prior to insertion into the shell. The wetting material can be any liquid that is suitable for use in an aerosol precursor composition. For example, the wetting material can comprise one or a combination of water, glycerin, propylene glycol, and the like. The amount of wetting liquid added to the fibrous substrate can be up to the maximum retention capacity of the fibrous substrate. Preferably, the wetted fibrous substrate inserted into the shell comprises an amount of liquid that is less than the maximum retention capacity of the dry substrate. This can allow for ease of addition of the aerosol precursor composition to the substrate after the wetted substrate is inserted into the shell. As such, the mass of liquid added to the dry fibrous substrate can be substantially less than the maximum retention capacity of the dry fibrous substrate, such as less than 75%, less than 50%, or less than 25% of the maximum retention capacity of the dry fibrous substrate. The wetting liquid can be added to the fibrous substrate by any suitable means, such as dipping, spraying, injecting, or the like.

In some embodiments, the mass of liquid added to the dry fibrous substrate can be greater than the mass of the liquid that is present in the wetted fibrous substrate when inserted into the shell. In particular embodiments, the mass of liquid in the wetted fibrous substrate when inserted into the shell can be less than 75%, less than 50%, less than 25%, or less than 10% of the maximum retention capacity of the dry fibrous substrate. Thus, the method of the present disclosure further can comprise removing at least a portion of the added liquid from the wetted fibrous substrate prior to inserting the wetted fibrous substrate into the shell. For example, at least 5%, at least 10%, at least 25%, at least 50%, or at least 75% by weight of the liquid added to the dry fibrous substrate can be removed from the wetted substrate prior to insertion into the shell. As such, the present methods can comprise adding a wetting liquid to the dry fibrous substrate to form a high percentage wetted substrate and then removing a portion of the wetting liquid from the high percentage wetted substrate to form a low percentage wetted substrate. For example, the high percentage wetted substrate may comprise wetting liquid in a content of about 25% to 100% of the maximum retention capacity of the dry fibrous substrate. The low percentage wetted substrate can comprise the wetting liquid in a content of about 50% to about 1% of the maximum retention capacity of the dry fibrous substrate. It is understood that the present methods are carried out such that the amount of wetting liquid in the low percentage wetted substrate is less than the amount of the wetting liquid that the high percentage wetted substrate. In some embodiments, the wetted substrate inserted into the shell can comprise a mass of liquid that is about 5% or greater, about 10% or greater, about 25% or greater, or about 50% or greater than the dry mass of the dry fibrous substrate. Preferably, processing of the fibrous substrate according to the present disclosure does not significantly reduce the mass of fibrous material present in the fibrous substrate. For example, the mass of fibrous material in the wetted fibrous substrate can be equal to the mass of fibrous material in the dry fibrous substrate or may be less than the mass of the fibrous material in the dry fibrous substrate by no more than 5%, no more than 3%, or no more than 1%.

The fibrous substrate can have a range of basis weights. In some embodiments, a fibrous substrate useful according to the present disclosure can have a basis weight of about 100 grams per square meter (gsm) to about 250 gsm, about 120 gsm to about 220 gsm, or about 140 gsm to about 200 gsm.

Removal of the wetting liquid can be by any suitable means, such as one or more of air drying, heat drying, or through application of pressure to the wetted fibrous substrate. In some embodiments, the wetted fibrous substrate can be pressed, such as by passing through one or more sets of rollers or through subjection to static pressing. Preferably, the wetting liquid removed from the wetted substrate can be recycled for use in wetting further dry fibrous substrates and/or for use in an aerosol precursor composition.

Application of pressure, such as with rollers of the like, can be useful for reducing the thickness of the fibrous substrate, which also can improve assembly of the aerosol delivery device. In particular, the fibrous substrate prior to the wetting step can be defined by a first thickness, which can be an average thickness. After the step of removing at least a portion of the liquid, the wetted fibrous substrate can be defined by a second thickness that is less than the first thickness. In some embodiments, the second thickness can be less than the first thickness by at least 5%, at least 10%, at least 15%, or at least 20%. Thus, the fibrous material may be compressed without any significant loss of material.

Wetting the fibrous substrate with a wetting liquid (and optionally removing a portion of the wetting liquid, such as by pressing) can be beneficial for improving the assembly of an aerosol delivery device. For example, in some embodiments, one or more of the following benefits can be realized:

the edges of the fibrous substrate may exhibit reduced incidence of delamination or fraying and thus exhibit reduced propensity for catching or snagging on the shell during insertion;

the average thickness of the fibrous substrate may be reduced and thus may improve the ease of insertion of the reservoir substrate into the shell; and the wettability of the reservoir after insertion into the shell may be improved, thereby facilitating the process of the loading the aerosol precursor composition into the device.

In some embodiments, the method can include shaping the wetted fibrous substrate. For example, the shell of the aerosol delivery device can have a specific cross-sectional shape, such as being substantially round, and the wetted fibrous substrate can be formed into a shape that substantially corresponds to the cross-sectional shape of the shell. In some embodiments, the wetted fibrous substrate, for example, can be substantially flattened in shape. The wetted fibrous substrate, for example, can be substantially square or rectangular in shape. In some embodiments, the shell can be substantially cylindrical. Further, for example, the fibrous substrate can be substantially flat (i.e., the thickness is less than the width and less than the length), and the method can comprise configuring the reservoir substrate such that the wetted fibrous substrate is substantially cylindrical. The wrapping can comprise configuring opposing ends of the substantially flat wetted fibrous substrate to be overlapping or to be abutting. In some embodiments, wrapping can comprise wrapping the wetted fibrous substrate around a mandrel or other support such that opposing ends of the wetted fibrous substrate overlap or substantially abut. The support can be a mold that is not inserted into the aerosol delivery device. In some embodiments, the support can comprise one or more further elements of the aerosol delivery device, such as the liquid transport element, the heater, electrical contacts, and an air flow tube. In some embodiments, the support can comprise a central flow tube with integrated electrical contacts. The central flow tube can be configured such that the liquid transport element can be interposed between the flow tube and the wetted fibrous substrate, which is wrapped therearound.

The wetted fibrous substrate can be inserted into the shell after one or more further components of the aerosol delivery device have been added to the shell. In some embodiments, the wetted fibrous substrate can be combined with an atomizer, for example, and the combination of the atomizer and the wetted fibrous substrate can be inserted into the shell. An exemplary atomizer can include an air flow tube, a liquid transport element, and a heater. The atomizer also may include electrical contacts, which may be integrated into the air flow tube.

The method also can comprise adding an aerosol precursor composition to the wetted fibrous substrate after the wetted fibrous substrate has been inserted into the shell. For example, the aerosol precursor composition can be added to an end of the fibrous substrate or injected into the fibrous substrate. In some embodiments, at least one end of the shell can be closed (e.g., with a cap or a base), and the method can comprise filling at least a portion of the shell with the aerosol precursor composition and allowing the composition to sorb into the fibrous reservoir.

The aerosol precursor, or vapor precursor composition, can vary. Most preferably, the aerosol precursor is composed of a combination or mixture of various ingredients or components. The selection of the particular aerosol precursor components, and the relative amounts of those components used, may be altered in order to control the overall chemical composition of the mainstream aerosol produced by the aerosol generating piece. Of particular interest are aerosol precursors that can be characterized as being generally liquid in nature. For example, representative generally liquid aerosol precursors may have the form of liquid solutions, viscous gels, mixtures of miscible components, or liquids incorporating suspended or dispersed components. Typical aerosol precursors are capable of being vaporized upon exposure to heat under those conditions that are experienced during use of the aerosol generating pieces that are characteristic of the current disclosure; and hence are capable of yielding vapors and aerosols that are capable of being inhaled.

For aerosol delivery systems that are characterized as electronic cigarettes, the aerosol precursor most preferably incorporates tobacco or components derived from tobacco. In one regard, the tobacco may be provided as parts or pieces of tobacco, such as finely ground, milled or powdered tobacco lamina. In another regard, the tobacco may be provided in the form of an extract, such as a spray dried extract that incorporates many of the water soluble components of tobacco. Alternatively, tobacco extracts may have the form of relatively high nicotine content extracts, which extracts also incorporate minor amounts of other extracted components derived from tobacco. In another regard, components derived from tobacco may be provided in a relatively pure form, such as certain flavoring agents that are derived from tobacco. In one regard, a component that is derived from tobacco, and that may be employed in a highly purified or essentially pure form, is nicotine (e.g., pharmaceutical grade nicotine).

The aerosol precursor may incorporate a so-called "aerosol forming materials." Such materials have the ability to yield visible aerosols when vaporized upon exposure to heat under those conditions experienced during normal use of aerosol generating pieces that are characteristic of the current disclosure. Such aerosol forming materials include various polyols or polyhydric alcohols (e.g., glycerin, propylene glycol, and mixtures thereof). Many embodiments of the present disclosure incorporate aerosol precursor components that can be characterized as water, moisture or aqueous liquid. During conditions of normal use of certain aerosol generating pieces, the water incorporated within those pieces can vaporize to yield a component of the generated aerosol. As such, for purposes of the current disclosure, water that is present within the aerosol precursor may be considered to be an aerosol forming material.

It is possible to employ a wide variety of optional flavoring agents or materials that alter the sensory character or nature of the drawn mainstream aerosol generated by the aerosol delivery system of the present disclosure. For example, such optional flavoring agents may be used within the aerosol precursor to alter the flavor, aroma and organoleptic properties of the aerosol. Certain flavoring agents may be provided from sources other than tobacco. Exemplary flavoring agents may be natural or artificial in nature, and may be employed as concentrates or flavor packages.

Exemplary flavoring agents include vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar and pipe tobaccos. Syrups, such as high fructose corn syrup, also can be employed. Certain flavoring agents may be incorporated within aerosol forming materials prior to formulation of a final aerosol precursor mixture (e.g., certain water soluble flavoring agents can be incorporated within water, menthol can be incorporated within propylene glycol, and certain complex flavor packages can be incorporated within propylene glycol).

Aerosol precursors also may include ingredients that exhibit acidic or basic characteristics (e.g., organic acids, ammonium salts or organic amines). For example, certain organic acids (e.g., levulinic acid, succinic acid, lactic acid, and pyruvic acid) may be included in an aerosol precursor formulation incorporating nicotine, preferably in amounts up to being equimolar (based on total organic acid content) with the nicotine. For example, the aerosol precursor may include about 0.1 to about 0.5 moles of levulinic acid per one mole of nicotine, about 0.1 to about 0.5 moles of succinic acid per one mole of nicotine, about 0.1 to about 0.5 moles of lactic acid per one mole of nicotine, about 0.1 to about 0.5 moles of pyruvic acid per one mole of nicotine, or various permutations and combinations thereof, up to a concentration wherein the total amount of organic acid present is equimolar to the total amount of nicotine present in the aerosol precursor.

As one non-limiting example, a representative aerosol precursor can have the form of a mixture of about 70% to about 90% glycerin, often about 75% to about 85% glycerin; about 5% to about 20% water, often about 10% to about 15% water; about 1% to about 10% propylene glycol, often about 4% to about 8% propylene glycol; about 0.1% to about 6% nicotine, often about 1.5% to about 5% nicotine; and optional flavoring agent in an amount of up to about 6%, often about 0.1% to about 5% flavoring agent; on a weight basis. For example, a representative aerosol precursor may have the form of a formulation incorporating greater than about 76% glycerin, about 14% water, about 7% propylene glycol, about 1% to about 2% nicotine, and less than about 1% optional flavoring agent, on a weight basis. For example, a representative aerosol precursor may have the form of a formulation incorporating greater than about 75% glycerin, about 14% water, about 7% propylene glycol, about 2.5% nicotine, and less than about 1% optional flavoring agent. For example, a representative aerosol precursor may have the form of a formulation incorporating greater than about 75% glycerin, about 5% water, about 8% propylene glycol, about 6% nicotine, and less than about 6% optional flavoring agent, on a weight basis.

As another non-limiting example, a representative aerosol precursor can have the form of a mixture of about 40% to about 70% glycerin, often about 50% to about 65% glycerin; about 5% to about 20% water, often about 10% to about 15% water; about 20% to about 50% propylene glycol, often about 25% to about 45% propylene glycol; about 0.1% to about 6% nicotine, often about 1.5% to about 5% nicotine; about 0.5% to about 3%, often about 1.5% to about 2% menthol; and optional additional flavoring agent in an amount of up to about 6%, often about 0.1% to about 5% flavoring agent; on a weight basis. For example, a representative aerosol precursor may have the form of a formulation incorporating about 50% glycerin, about 11% water, about 28% propylene glycol, about 5% nicotine, about 2% menthol, and about 4% other flavoring agent, on a weight basis.

Representative types of aerosol precursor components and formulations also are set forth and characterized in U.S. Pat. No. 7,217,320 to Robinson et al. and U.S. Pat. Pub. Nos. 2013/0008457 to Zheng et al.; 2013/0213417 to Chong et al. and 2014/0060554 to Collett et al., the disclosures of which are incorporated herein by reference. Other aerosol precursors that may be employed include the aerosol precursors that have been incorporated in the VUSE® product by R. J. Reynolds Vapor Company, the BLU™ product by Lorillard Technologies, the MISTIC MENTHOL product by Mistic Ecigs, and the VYPE product by CN Creative Ltd. Also desirable are the so-called "smoke juices" for electronic cigarettes that have been available from Johnson Creek Enterprises LLC.

The amount of aerosol precursor that is incorporated within the aerosol delivery system is such that the aerosol generating piece provides acceptable sensory and desirable performance characteristics. For example, it is highly preferred that sufficient amounts of aerosol forming material (e.g., glycerin and/or propylene glycol), be employed in order to provide for the generation of a visible mainstream aerosol that in many regards resembles the appearance of tobacco smoke. The amount of aerosol precursor within the aerosol generating system may be dependent upon factors such as the number of puffs desired per aerosol generating piece. Typically, the amount of aerosol precursor incorporated within the aerosol delivery system, and particularly within the aerosol generating piece, is less than about 2 g, generally less than about 1.5 g, often less than about 1 g and frequently less than about 0.5 g.

The aerosol precursor composition can have at least one component in common with the wetting liquid. In some embodiments, the wetting liquid can be a material that is not present in the aerosol precursor composition. For example, the following exemplary embodiments are illustrative of the combinations of materials that may be used:

- the wetting liquid is water, and the aerosol precursor composition comprises water as one component thereof;
- the wetting liquid is glycerin, and the aerosol precursor composition comprises glycerin as one component thereof;
- the wetting liquid is propylene glycol, and the aerosol precursor composition comprises propylene glycol as one component thereof;
- the wetting liquid is water and glycerin, and the aerosol precursor composition comprises water and glycerin as two components thereof;
- the wetting liquid is water and propylene glycol, and the aerosol precursor composition comprises water and propylene glycol as two components thereof;
- the wetting liquid is glycerin and propylene glycol, and the aerosol precursor composition comprises glycerin and propylene glycol as two components thereof;
- the wetting liquid is water, glycerin, and propylene glycol, and the aerosol precursor composition comprises water, glycerin, and propylene glycol as three components thereof;
- the wetting liquid is water, and the aerosol precursor composition comprises glycerin;
- the wetting liquid is water, and the aerosol precursor composition comprises glycerin and propylene glycol;
- the wetting liquid is water, and the aerosol precursor composition comprises propylene glycol;
- the wetting liquid is glycerin, and the aerosol precursor composition comprises water;
- the wetting liquid is glycerin, and the aerosol precursor composition comprises water and propylene glycol;
- the wetting liquid is glycerin, and the aerosol precursor composition comprises propylene glycol;

the wetting liquid is propylene glycol, and the aerosol precursor composition comprises water;

the wetting liquid is propylene glycol, and the aerosol precursor composition comprises water and glycerin; and the wetting liquid is propylene glycol, and the aerosol precursor composition comprises glycerin.

When the wetting liquid comprises two or more components, the various components can be combined in a variety of ratios. For example, water and glycerin or water and propylene glycol can be combined at a weight ratio of 1:99 to 99:1, 10:90 to 90:10, 25:75 to 75:25, or 50:50. When the wetting liquid comprises water, glycerin, and propylene glycol, the water can comprise 1% by weight to about 99% by weight, about 2% to about 75% by weight, or about 5% to about 50% by weight of the combination. When glycerin and propylene glycol are both included in the wetting liquid, the glycerin and propylene glycol can be present in a ratio of 1:99 to 99:1 by weight, 10:90 to 90:10 by weight, or 50:50 to 75:25 by weight.

In some embodiments, separate components of an aerosol precursor composition can be added to the fibrous substrate at separate times. For example, all or a portion of a first component of an aerosol precursor composition can be used as the wetting liquid. The remaining components of the aerosol precursor composition can be added after the fibrous substrate is inserted into the shell along with any remaining portion of the first component. In some embodiments, water may be used as a wetting liquid, and the addition of the water to the fibrous substrate in this manner can reduce or eliminate the amount of water that may be included in the aerosol precursor composition. Thus, the aerosol precursor composition can be concentrated (i.e., include less water or no water). Part or all of the water that may be desired in an aerosol precursor composition can be added to the fibrous substrate as the wetting liquid, and the amount of water present in the aerosol precursor composition that is added after the fibrous substrate has been inserted into the shell can be reduced or eliminated. As such, the present disclosure can comprise reducing the amount of water (or another component of an aerosol precursor composition) that is present in the aerosol precursor composition that is added to the fibrous substrate after the fibrous substrate has been combined with the shell. This can be beneficial to improve processing in that the aerosol precursor composition added the fibrous substrate after the fibrous substrate has been combined with the shell can be absorbed quicker by the wetted fibrous substrate and/or the composition of the aerosol precursor composition added to the fibrous substrate after the fibrous substrate has been added to the shell can be simplified (i.e., include fewer components).

Additional representative types of components that yield visual cues or indicators, such as light emitting diode (LED) components, and the configurations and uses thereof, are described in U.S. Pat. No. 5,154,192 to Sprinkel et al.; U.S. Pat. No. 8,499,766 to Newton and U.S. Pat. No. 8,539,959 to Scatterday; and U.S. patent application Ser. No. 14/173,266, filed Feb. 5, 2014, to Sears et al.; which are incorporated herein by reference.

Yet other features, controls or components that can be incorporated into aerosol delivery systems of the present disclosure are described in U.S. Pat. No. 5,967,148 to Harris et al.; U.S. Pat. No. 5,934,289 to Watkins et al.; U.S. Pat. No. 5,954,979 to Counts et al.; U.S. Pat. No. 6,040,560 to Fleischhauer et al.; U.S. Pat. No. 8,365,742 to Hon; U.S. Pat. No. 8,402,976 to Fernando et al.; U.S. Pat. App. Pub. Nos. 2010/0163063 by Fernando et al.; 2013/0192623 to Tucker et al.; 2013/0298905 to Leven et al.; 2013/0180553 to Kim et al. and 2014/0000638 to Sebastian et al.; and U.S. patent application Ser. No. 13/840,264, filed Mar. 15, 2013, to Novak et al. and Ser. No. 13/841,233, filed Mar. 15, 2013, to DePiano et al.; which are incorporated herein by reference.

In some embodiments, the present disclosure provides an input for use in an aerosol delivery device. Particularly, the input can be configured for insertion to a shell or housing of an aerosol delivery device. In some embodiments, an input can comprise a liquid transport element, a heater in a heating arrangement with the liquid transport element, and a wetted fibrous substrate wrapped around at least a portion of the liquid transport element. In particular, the wetted fibrous substrate can have an inner surface in a wicking arrangement with the liquid transport element and can have an outer surface having a maximum diameter that is less than the diameter of the inner surface of the aerosol delivery device housing. In some embodiments, the maximum outer diameter of the wetted fibrous substrate can have a maximum outer diameter that substantially corresponds to the diameter of the inner surface of the aerosol delivery device housing. In other words, the maximum outer diameter can be less than the inner diameter of the housing by up to 10%, up to 5%, or up to 2%. In other embodiments, the maximum diameter of the outer surface of the wetted substrate can be less than the diameter of the inner surface of the aerosol delivery device housing by about 0.1% to about 10%, about 0.5% to about 10%, or about 1% to about 5%. The wrapped, wetted fibrous substrate can be configured relative to the remaining elements of the input such that the heater extends beyond an end of the wetted fibrous substrate. The nature of the elements of the input can be as otherwise described herein.

One embodiment of an input is shown in FIG. 2. As seen therein, an input 401 comprises an atomizer 412 and a wetted fibrous substrate 462. The atomizer 412 comprises a heating element 440, a liquid transport element 438, and a flow tube 410, which has a central opening 460 therethrough. Electrical terminals 434*a* and 434*b* are also illustrated and are positioned in first and second slots 458*a* and 458*b* of the flow tube 410. The electrical terminals 434*a* and 434*b* include tabs 436*a* and 436*b* configured to make an electrical engagement with the heating element 440. The wetted fibrous substrate 462 is wrapped around the atomizer 412 such that the liquid transport element 438 is in a wicking arrangement therewith and is positioned between the wetted fibrous substrate and the flow tube 410. The wetted fibrous substrate 462 is wrapped to form a but joint 456. The wetted fibrous substrate 462 includes an outer surface 414 and in inner surface 452, as well as first end 454*a* and a second end 454*b*. In the illustrated embodiment, the input 401 is engaging a base 404 that includes a plurality of ribs 432 configured to engage a shell. As seen in FIG. 2, the outer surface 414 of the wetted fibrous substrate 462 defines a maximum diameter that substantially aligns with the plurality of ribs 432. As such, it can be seen that the maximum diameter of the outer surface 414 of the wetted fibrous substrate 462 substantially corresponds to the diameter of an inner surface of the aerosol delivery device housing, which is configured to slide over the input 401 so as to engage the plurality of ribs 432 and the base 404. As also seen, the heating element 440 extends beyond the second end 454*b* of the wetted fibrous substrate 462.

The foregoing description of use of the article can be applied to the various embodiments described herein through minor modifications, which can be apparent to the person of skill in the art in light of the further disclosure provided herein. The above description of use, however, is not intended to limit the use of the article but is provided to comply with all necessary requirements of disclosure of the present disclosure.

Any of the elements shown in the article illustrated in FIG. 1 or as otherwise described above may be included in an aerosol delivery device according to the present disclosure. In particular, any of the above described and illustrated components of a control body can be incorporated into a control body according to the present disclosure. Likewise, any of the above described and illustrated components of a cartridge can be incorporated into a cartridge that can be combined with a control body according to the present disclosure.

EXPERIMENTAL

The present invention will now be described with specific reference to the following examples, which are not intended to be limiting of the invention and are rather provided to show exemplary embodiments.

Example 1

A nonwoven material suitable for use as a fibrous reservoir substrate was prepared and evaluated in relation to changes in thickness after wetting. The fibrous reservoir was formed of cellulose acetate and had an initial, dry average thickness of 1.8 mm. The control sample thickness was unchanged during testing. The test samples were sized at 24.5 mm by 18 mm and had the same starting thickness. The cellulose acetate reservoir Test Sample 1 was wetted by immersion with a wetting liquid formed of 100% water, and Test Sample 2 was wetted by immersion with a wetting liquid formed of a combination of glycerin, propylene glycol, and water at a ratio of 80:15:5 based on weight. Each of the wetted test samples was passed three times through a roller press. The rollers were adjusted to be in physical contact with one another, and the test samples were passed between the rollers to remove a percentage of the liquid. Changes in average thickness of the cellulose acetate samples after rolling are shown in Table 1 below.

TABLE 1

| Sample Thickness | | |
|---|---|---|
| Control Sample | Test Sample 1 | Test Sample 2 |
| 1.8 mm | 1.0 mm | 1.5 mm |

As seen in Table 1, wetting with water and processing with the roller press reduced the average thickness of the cellulose acetate substrate by approximately 44.4%, and wetting with the glycerin, propylene glycol, water mixture and processing with the roller press reduced the average thickness of the cellulose acetate substrate by approximately 16.6%. An image of the cellulose acetate substrate dry (right-hand side) and after wetting with water and passing through the rollers (left-hand side) is shown in FIG. 3.

The control sample and Test Sample 1 were each wrapped around a mandrel with the opposing ends meeting in a butting joint. The image shown in FIG. 4 shows Test Sample 1 on the left and the Control Sample on the right. As can be seen in the figure, the Control Sample was significantly thicker and exhibited excessive fraying and loose fibers. The Control Sample also exhibited significant buckling at the joint. Test Sample 1 exhibited less buckling, had a significantly thinner profile, and exhibited less fraying. Test Sample 1 thus was shown to be in a configuration for improved insertion of the reservoir into a shell.

Example 2

Multiple cellulose acetate reservoir substrate samples were prepared to evaluate liquid retention capacity. All samples were prepared from the sample stock material with a basis weight of 160 grams per square meter (gsm) and dimensions of 24.5 mm by 18 mm by 1.8 mm thick. The dry cellulose acetate substrate (Control Sample) was weighed as well as Test Samples 3 through 7, which were each saturated with water to maximum retention and pressed through a roller assembly as described in Example 1. The weight of each sample after being pressed through the roller assembly is shown below in Table 2.

TABLE 2

| Sample | Weight (mg) |
|---|---|
| Control Sample - dry weight | 61.5 |
| Test Sample 3 | 184 |
| Test Sample 4 | 182 |
| Test Sample 5 | 181 |
| Test Sample 6 | 175 |
| Test Sample 7 | 174 |

As seen in Table 2, the liquid retention of the Test Samples after pressing was substantially consistent. Specifically, the average mass of water held in the 24.5 mm by 18 mm cellulose acetate reservoirs was 117.7 mg (+/−4.4 mg). Thus, the liquid retention of the cellulose acetate samples for water after pressing was approximately 191% by weight.

Example 3

Absorption rate in dry and pre-wetted cellulose acetate reservoir substrates was evaluated. Control and test substrate samples were approximately 24.5 mm by 18 mm with an initial thickness of 1.8 mm. A liquid was applied to the test and control samples, and the rate of absorption was recorded by video using a DynoLite microscope.

Test Sample 8 was wetted with water and passed through a roller press as described in Example 1. A single drop of water/dye mixture was added to Test Sample 8, and a single drop of water/dye mixture was added to the control sample. The water/dye drop sat on the surface of the control sample for a short time before absorption began. Approximately 6-7 seconds elapsed from addition of the drop until the water/dye appeared to have been fully absorbed and spread to its maximum diameter in the dry control sample. On the contrary, the water/dye drop added to Test Sample 8 appeared to absorb and achieve maximum spread almost immediately upon addition—i.e., in a time of about 0.1 to about 0.2 seconds. Thus, the absorption of the test liquid into the pre-wetted substrate (Test Sample 8) was found to be achieved at a rate that was approximately 50 times faster than with the control sample when water was used as the pre-wetting liquid and the test liquid.

Test Sample 9 was wetted with water and passed through a roller press as described in Example 1. Test Sample 10 was wetted with a combination of glycerin, propylene glycol, and water at a ratio of 80:15:5 based on weight and passed through a roller press as described in Example 1. The 80:15:5 ratio liquid was combined with a dye and used as the test liquid. A single drop of the test liquid was applied to Test Sample 9, and a single drop of the test liquid was applied to Test Sample 10. The drop of the test liquid was absorbed by Test Sample 10 at a rate that was approximately 50% faster than the rate at which the test liquid was absorbed by Test Sample 9. This indicated that absorption rate is faster when the fibrous substrate is pre-wetted with the same liquid that is later added. This further illustrated that a fibrous substrate pre-wetted with water rapidly absorbs and spreads a liquid comprising mainly glycerin and propylene glycol.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. A method of forming an aerosol delivery device comprising:

providing a fibrous substrate;

providing a shell;

wetting the fibrous substrate with a wetting liquid;

removing at least a portion of the liquid from the wetted fibrous substrate by applying pressure to the wetted fibrous substrate; and inserting the wetted fibrous substrate into the shell;

wherein, after the inserting step, the shell further comprises one or more of a heater, a liquid transport element, and an electrical connection.

2. The method according to claim 1, wherein applying pressure to the wetted fibrous substrate comprises passing the wetted fibrous substrate through one or more sets of rollers.

3. The method according to claim 1, comprising removing at least 25% by weight of the liquid from the wetted fibrous substrate.

4. The method according to claim 1, wherein the fibrous substrate prior to the wetting step has a first thickness, and wherein after the step of removing at least a portion of the liquid, the wetted fibrous substrate has a second thickness that is less than the first thickness by at least 5%.

5. The method according to claim 1, wherein the fibrous substrate has a maximum liquid retention capacity, and wherein the mass of liquid in the wetted fibrous substrate when inserted into the shell is less than 75% of the maximum retention capacity.

6. The method according to claim 1, wherein the shell has a cross-sectional shape, and wherein the method further comprises configuring the wetted fibrous substrate into a shape that substantially corresponds to the cross-sectional shape of the shell.

7. The method according to claim 1, wherein the shell is substantially cylindrical, wherein the wetted fibrous substrate is flat, and wherein the method comprises configuring the flat, wetted fibrous substrate to be substantially cylindrical.

8. The method according to claim 7, comprising wrapping the wetted fibrous substrate around a support such that opposing ends of the wetted fibrous substrate overlap or substantially abut.

9. The method according to claim 1, wherein the fibrous substrate is a nonwoven material.

10. The method according to claim 9, wherein the fibrous substrate comprises cellulose acetate.

11. The method according to claim 1, comprising:

providing the liquid transport element with the heater in communication therewith;

wrapping the wetted fibrous substrate around at least a portion of the liquid transport element; and inserting the wetted fibrous substrate in combination with the liquid transport element and the heater into the shell so that the heater is positioned beyond an end of the wetted fibrous substrate.

12. A method of forming an aerosol delivery device comprising:

providing a fibrous substrate;

providing a shell;

wetting the fibrous substrate with a wetting liquid;

inserting the wetted fibrous substrate into the shell; and adding an aerosol precursor composition to the fibrous substrate after the fibrous substrate has been inserted into the shell;

wherein, after the inserting step, the shell further comprises one or more of a heater, a liquid transport element, and an electrical connection.

13. The method according to claim 12, wherein the fibrous substrate has a maximum liquid retention capacity, and wherein the mass of liquid in the wetted fibrous substrate when inserted into the shell is less than 75% of the maximum retention capacity.

14. The method according to claim 12, wherein the shell has a cross-sectional shape, and wherein the method further comprises configuring the wetted fibrous substrate into a shape that substantially corresponds to the cross-sectional shape of the shell.

15. The method according to claim 12, wherein the shell is substantially cylindrical, wherein the wetted fibrous substrate is flat, and wherein the method comprises configuring the flat, wetted fibrous substrate to be substantially cylindrical.

16. The method according to claim 15, comprising wrapping the wetted fibrous substrate around a support such that opposing ends of the wetted fibrous substrate overlap or substantially abut.

17. The method according to claim 12, wherein the aerosol precursor composition has at least one component in common with the wetting liquid.

18. The method according to claim 12, wherein the fibrous substrate is a nonwoven material.

19. The method according to claim 18, wherein the fibrous substrate comprises cellulose acetate.

20. The method according to claim 12, comprising:

providing the liquid transport element with the heater in communication therewith;

wrapping the wetted fibrous substrate around at least a portion of the liquid transport element; and inserting the wetted fibrous substrate in combination with the liquid transport element and the heater into the shell so that the heater is positioned beyond an end of the wetted fibrous substrate.

* * * * *